US011312538B2

(12) United States Patent
Anzini

(10) Patent No.: US 11,312,538 B2
(45) Date of Patent: Apr. 26, 2022

(54) TREATMENT OF CLOSURE ENDS ON LARGE FORMAT BAGS

(71) Applicant: David Anzini, Middletown, NY (US)

(72) Inventor: David Anzini, Middletown, NY (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 34 days.

(21) Appl. No.: 16/336,150

(22) PCT Filed: Oct. 25, 2017

(86) PCT No.: PCT/US2017/058203

§ 371 (c)(1),
(2) Date: Mar. 25, 2019

(87) PCT Pub. No.: WO2018/081212

PCT Pub. Date: May 3, 2018

(65) Prior Publication Data

US 2019/0225381 A1 Jul. 25, 2019

Related U.S. Application Data

(60) Provisional application No. 62/413,644, filed on Oct. 27, 2016.

(51) Int. Cl.
*B65D 30/20* (2006.01)
*B65D 33/25* (2006.01)
(Continued)

(52) U.S. Cl.
CPC ..... *B65D 31/10* (2013.01); *B31B 70/148* (2017.08); *B31B 70/266* (2017.08);
(Continued)

(58) Field of Classification Search
CPC ..... B65D 31/10; B65D 2517/5064; B31B 70/148; B31B 70/266; B31B 70/8133
See application file for complete search history.

(56) References Cited

U.S. PATENT DOCUMENTS 5,364,189 A * 11/1994 Kuge ..... B65D 31/10 383/120
6,214,392 B1 * 4/2001 Ramirez ..... B65D 33/01 383/100

(Continued)

FOREIGN PATENT DOCUMENTS

JP 2005 297431 10/2005
WO 2006037240 4/2006

(Continued)

OTHER PUBLICATIONS

International Search Report for PCT/US2017/058203 dated Jan. 26, 2018.

*Primary Examiner* — Derek J Battisti
(74) *Attorney, Agent, or Firm* — McCarter & English, LLP

(57) ABSTRACT

Embodiments of the present disclosure provide a reclosure, closure or zipper on a large format package or bag that is mounted to the top of the package or bag, which may be formed from a tube of polymeric material, with the ends of the reclosure, closure or zipper flush to the sides of the bag. The upper corners of the package or bag includes notches in the gussets. The area of the package walls around the notches is pinned, glued or sealed together and the closure is attached to the package walls. The ends of the reclosure, closure or zipper are flush with the side edges or seals of the package or bag.

11 Claims, 5 Drawing Sheets

Large Format Polywoven Bag with Flush Mounted Closure

(51) Int. Cl.

| | |
|---|---|
| ***B31B 70/14*** | (2017.01) |
| ***B31B 70/26*** | (2017.01) |
| ***B31B 70/81*** | (2017.01) |
| ***B31B 160/20*** | (2017.01) |
| ***B31B 155/00*** | (2017.01) |

(52) U.S. Cl.
CPC ..... *B31B 70/8133* (2017.08); *B65D 33/2508* (2013.01); *B31B 2155/003* (2017.08); *B31B 2155/0012* (2017.08); *B31B 2160/20* (2017.08)

(56) References Cited

U.S. PATENT DOCUMENTS

| | | | | |
|---|---|---|---|---|
| 8,142,077 | B2 * | 3/2012 | Iannelli, II ..... | B65D 33/2591 383/64 |
| 2007/0065051 | A1 * | 3/2007 | Eads ..... | B65D 31/10 383/63 |
| 2008/0267539 | A1 * | 10/2008 | Howell ..... | B65D 33/2591 383/64 |
| 2009/0052812 | A1 * | 2/2009 | Plourde ..... | B65D 31/10 383/64 |
| 2010/0284633 | A1 * | 11/2010 | Dytchkowskyj ... | B65D 33/2591 383/64 |
| 2012/0281934 | A1 * | 11/2012 | Dytchkowskyj ... | B65D 33/2591 383/64 |

FOREIGN PATENT DOCUMENTS

| | | |
|---|---|---|
| WO | 2014/014612 | 1/2014 |
| WO | 2018081212 | 5/2018 |

* cited by examiner

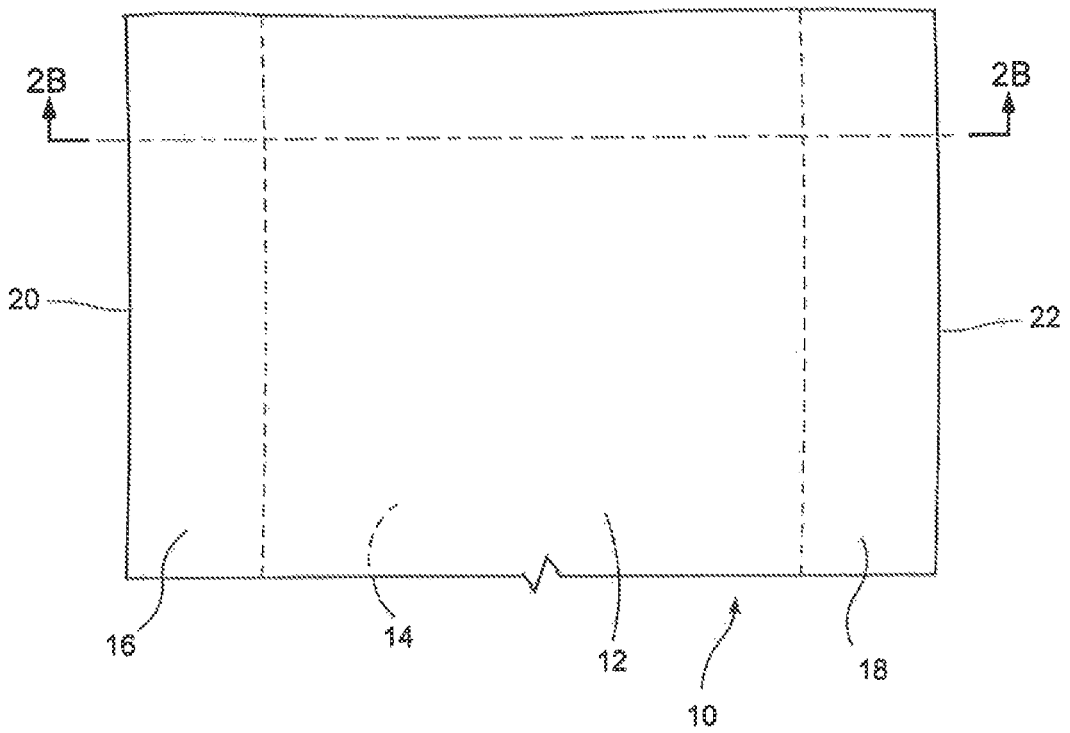
F I G. 2A. Polywoven Tube
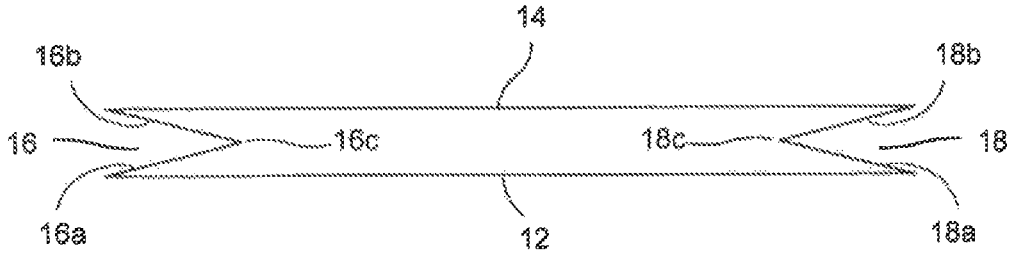
F I G. 2B

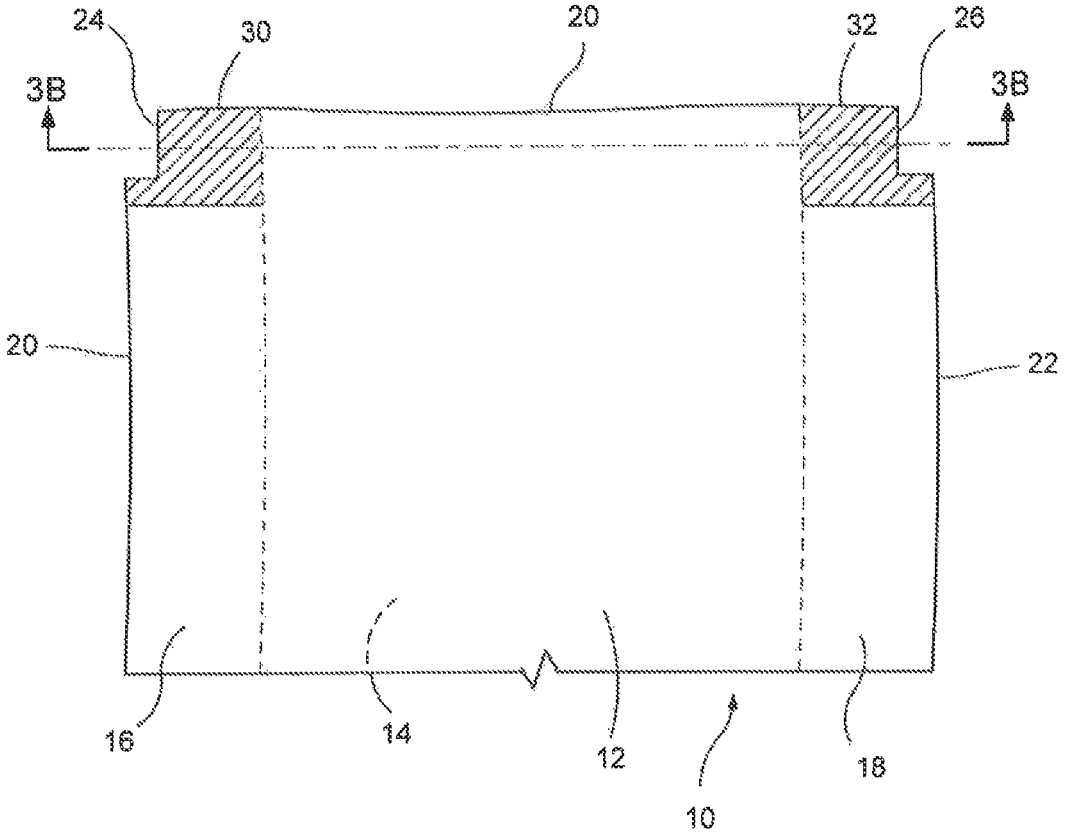
F I G. 3A. Partial removal of Gusset Material
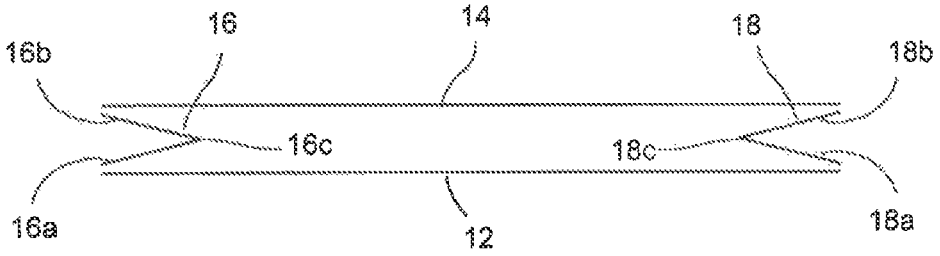
F I G. 3B

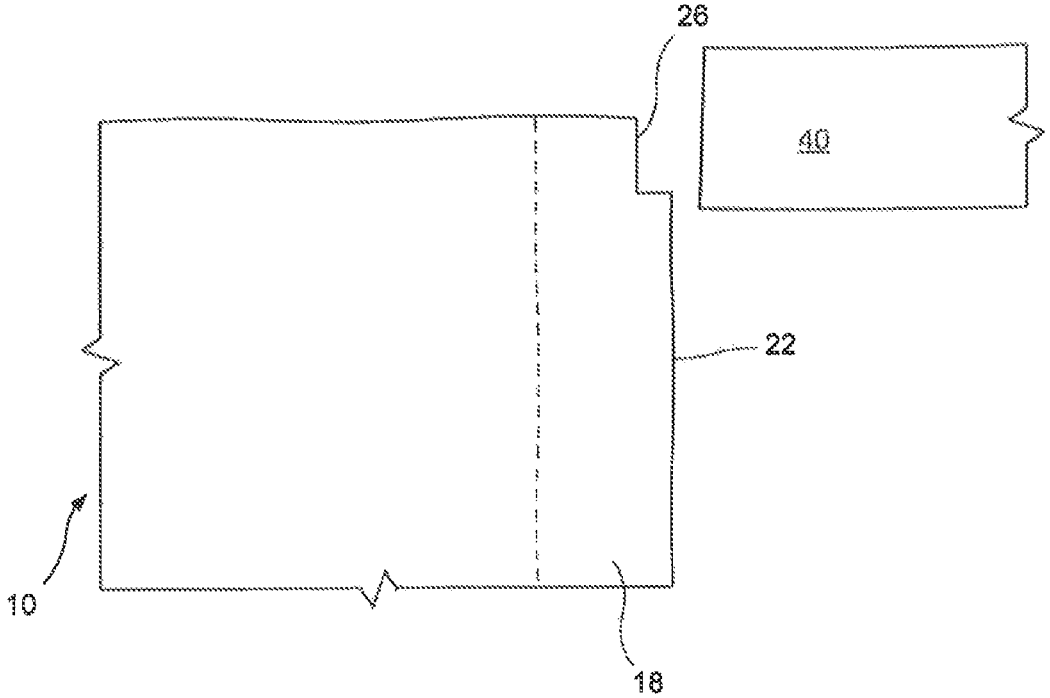
F I G. 4. Relative Position of Closure
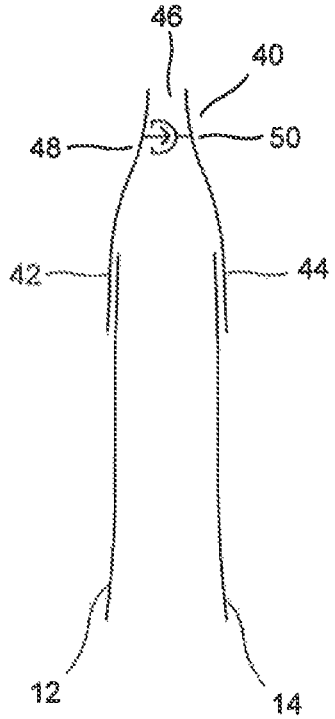
F I G. 5B

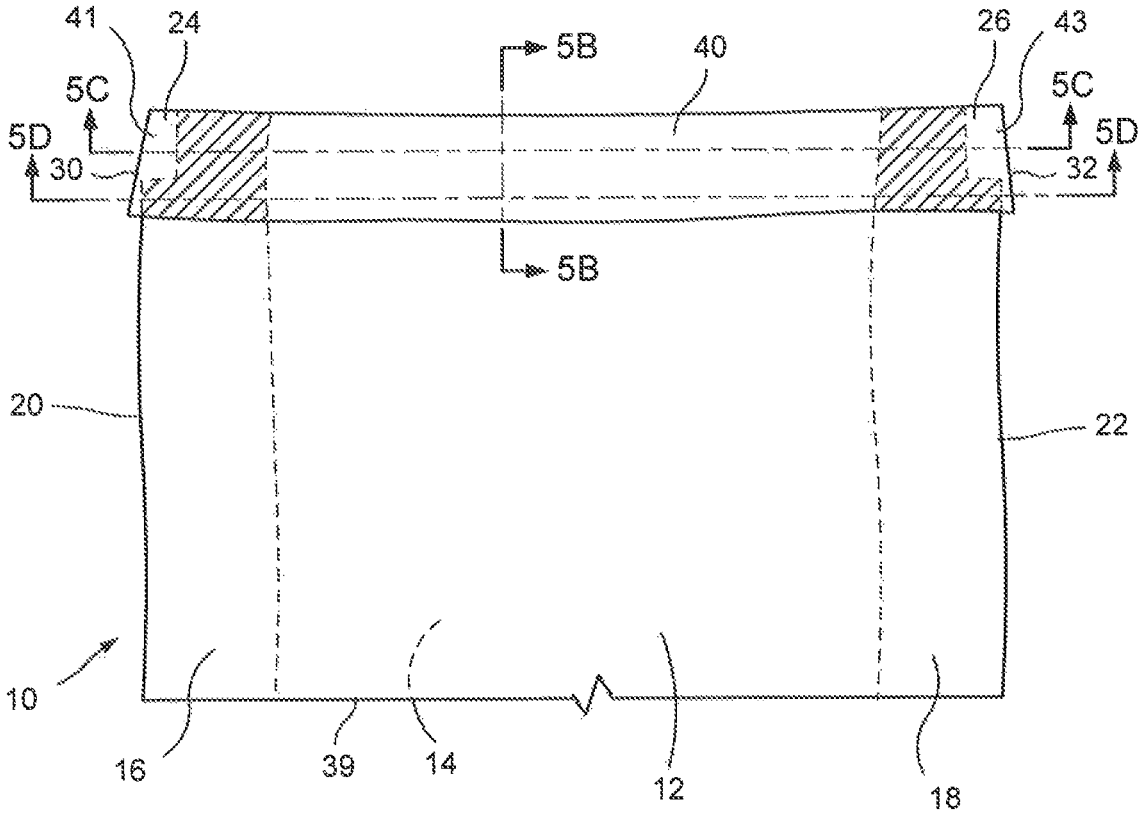
F I G. 5A. Large Format Polywoven Bag with Flush Mounted Closure
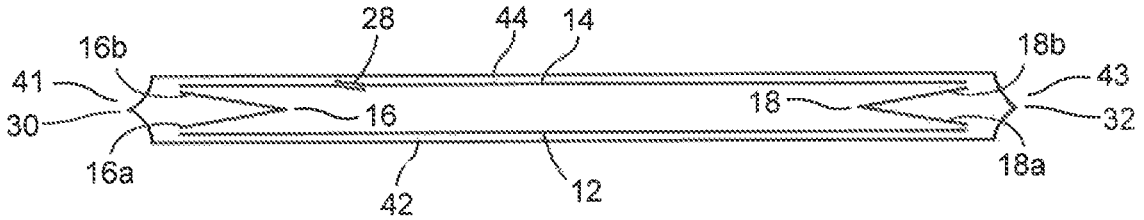
F I G. 5C
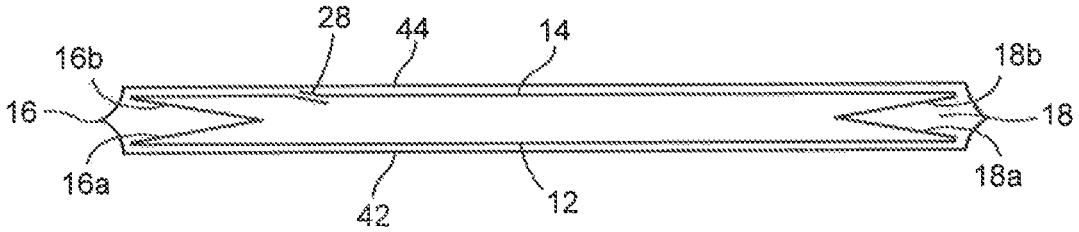
F I G. 5D

TREATMENT OF CLOSURE ENDS ON LARGE FORMAT BAGS

This application is a National Phase application of PCT/US2017/058203, filed on Oct. 25, 2017, which claims priority under 35 U.S.C. 119(e) of U.S. provisional application Ser. No. 62/413,644, filed on Oct. 27, 2016, the contents of which are hereby incorporated by reference in their entirety and for all purposes.

BACKGROUND OF THE DISCLOSURE

Field of the Disclosure

The disclosure pertains to a closure on a large format bag that typically is mounted to the top of the bag with the ends of the closure flush to the sides of bag.

Description of the Prior Art

With respect to polywoven large format bags ("large format bags" generally referring to bags intended for at least fifteen pounds of product), reclosure prior art has typically taken the form of a large flanged closure that is sealed to the external faces of the bag, with the flange portions of the closure extending beyond the sides of the bag, typically by a half-inch or more. This is functional but not aesthetically pleasing. In addition, the extra flange material can become cumbersome in the user's fill-seal operation. Embodiments of this disclosure address both of the above issues by providing a closure and means of attachment that renders the closure ends flush with the sides of the bag material.

OBJECTS AND SUMMARY OF THE DISCLOSURE

It is therefore an object of the present disclosure to provide a closure for a large format package or bag which will run on fill and seal machinery more efficiently than in the prior art. In particular, a closure is sought wherein the ends have a reduced propensity to catch on the machinery.

It is therefore a further object of the present disclosure to provide a closure for a large format package or bag which is resistant to insect or pest infiltration and which is aesthetically pleasing to the consumer.

These and other objects are attained by providing a closure on a large format gusseted package or bag that is mounted to the top of the bag with the ends of the closure flush to the sides of the bag. The side gussets are notched near the top of the bag, and the area around the gussets is pinned, sealed or glued.

BRIEF DESCRIPTION OF THE DRAWINGS

Further objects and advantages of the disclosure will become apparent from the following description and from the accompanying drawings, wherein:

FIG. 2A is a plan view, partially in phantom, of polywoven tube, a step in the manufacturing process of an embodiment of the present disclosure.

FIG. 2B is a cross-sectional view along plane 2B-2B of FIG. 2A.

FIG. 3A is a plan view, partially in phantom of the polywoven tube, illustrating a further step in the manufacturing process of an embodiment of the present disclosure, wherein the sides of the tube, including a portion of the gussets have been partially removed.

FIG. 3B is a cross-sectional view along plane 3B-3B of FIG. 3A.

FIG. 4 is a plan view, partially in phantom, illustrating the position of the reclosure or zipper with respect to the gusset material removed, in an embodiment of the present disclosure.

FIG. 5A is a plan view, partially in phantom, illustrating the top of the package of an embodiment of the present disclosure.

FIG. 5B is a cross-sectional view along plane 5B-5B of FIG. 5A.

FIG. 5C is a cross-sectional view along plane 5C-5C of FIG. 5A.

FIG. 5D is a cross-sectional view along plane 5D-5D of FIG. 5A.

DETAILED DESCRIPTION OF THE PREFERRED EMBODIMENTS

Figure 1:
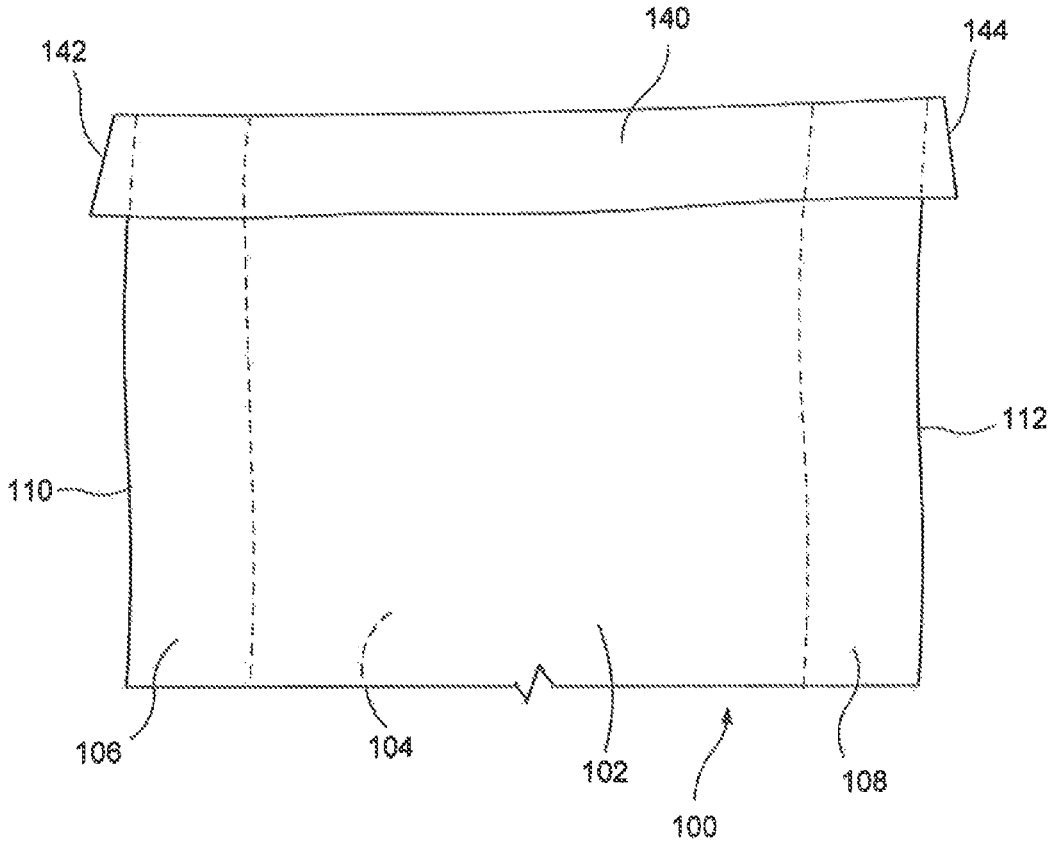
F I G. 1 PRIOR ART
FIG. 1 is a plan view, partially in phantom, of a gusseted package of the prior art.

Referring now to the drawings in detail wherein like numerals refer to like elements throughout the several views, one sees that FIG. 1 is a representation of a gusseted package 100 of the prior art, including flanges of the reclosure 140 wherein the ends 142, 144 extend beyond the side edges or seals 110, 112 of the package 100 as formed by front and rear walls 102, 104 which are joined to each other by first and second side gussets 106, 108.

FIG. 2A illustrates an embodiment of the present disclosure, showing a typical top of a polywoven or polymeric tube which is formed from front wall 12, rear wall 14 and first and second side gussets 16, 18, as bounded by first and second side seals or edges 20, 22, respectively (the tube may be formed from a single sheet of polymeric material by way of lap seal 28 as shown in FIGS. 5C and 5B). A storage volume for consumer or other products is formed between the front and rear walls 12, 14. Moreover, as shown in the cross-sectional view of FIG. 2B, first side gusset 16 is formed by first gusset front wall 16*a* and first gusset rear wall 16*b*, which are connected or integral with each other at a first interior apex 16*c*, and connected or integral with front wall 12 and rear wall 14, respectively. Likewise, second side gusset 18 is formed by second gusset front wall 18*a* and second gusset rear wall 18*b*, which are connected or integral with each other at a second interior apex 18*c*, and connected or integral with front wall 12 and rear wall 14, respectively. This configuration is a manufacturing precursor component to the finished bag or package 10 (see FIG. 5A). The illustrated embodiment has relatively deep first and second side gussets 16, 18.

FIG. 3A illustrates a subsequent manufacturing precursor to the finished bag or package 10. FIG. 3A shows the partial removal of the sides of the tube, approximately half the depth of the first and second side gussets 16, 18, thereby resulting in first and second notches 24, 26, on opposed extremes of the upper edge of the front wall 12 and the rear wall 14 and on the upper portions of first and second side seals or edges 20, 22 respectively. This step of forming the first and second notches 24, 26 may be performed prior to or after the typical treatment of the first and second side gussets 16, 18 with hot melt adhesive, thereby pinning, sealing or gluing the first and second side gussets 16, 18 together at the top of the bag or package 10 in first and second gusset seal areas 33, 35 as shown in hatching in FIGS. 3A and 5A. FIG. 3B illustrates that the first and second interior apices 16*c*, 18*c* remain intact immediately inwardly adjacent from the respective first and second notches 24, 26, while the connection between first and second gusset front walls 16*a*, 18*a* and front wall 12 and between first and second gusset rear walls 16*b*, 18*b* and rear wall 14 have been removed or severed in this area.

The first and second gusset seal areas 33, 35, as shown in FIGS. 3A and 5A, formed by the pinning, sealing or gluing of the gusset walls 16*a*, 16*b* and 18*a*, 18*b* typically prevents, minimizes or reduces pest infiltration into the package or bag 10. This is particularly important in the packaging of pet foods. Moreover, fully sealing the ends of the reclosure, closure or zipper 40 (see FIG. 5A) around the first and second side gussets 16, 18 and all the way up the sides of the reclosure, closure or zipper 40 further helps to prevent pest infiltration.

FIG. 4 shows the relative position of the reclosure, closure or zipper 40 with respect to the amount of material removed from second side gusset 18 by second notch 26. The portion of the second side gusset 18 that remains proximate to second notch 26 is pinned with hot melt adhesive or otherwise sealed or glued.

FIG. 5A shows the top of the finished package or bag 10, with a flush cut reclosure, closure or zipper 40, bounded by first and second ends 41, 43, fitted over the first and second side gussets 16, 18 and first and second notches 24, 26 of package or bag 10. The first and second ends 41, 43 of reclosure, closure or zipper 40 are substantially flush or aligned with first and second side seals or edges 20, 22, thereby typically reducing the tendency of the package or bag 10 to catch during the manufacturing, filling or similar processes. The reclosure, closure or zipper 40 is typically adhered to the polywoven front and rear walls 12, 14 by hot melt adhesive, hot air heat sealing or other similar method as would be known to a person skilled in the art. The first and second ends 41, 43 of the reclosure, closure or zipper 40 that cover the first and second notches 24, 26 (i.e., the cut-out portions of the first and second side gussets 16, 18) can be sealed with adhesive, hot air, or heat and compression with a sealing bar, or other methods as would be known to a person skilled in the art. The first and second ends 41, 43 of the reclosure, closure or zipper 40 are then flush with the first and second side seals or edges 20, 22, and the top (reclosure, closure or zipper 40) is properly sealed to the package or bag 10. Additionally, a bottom seal 39 between the bottom edges of the front wall 12 and the rear wall 14 is formed to complete the function of the package or bag 10. The disclosed package or bag 10 is particularly adaptable to a large format bag, typically holding at least fifteen pounds of product, such as, but not limited to, consumer product.

FIG. 5B illustrates a typical cross-sectional view of the reclosure, closure or zipper 40 wherein first and second flange walls 42, 44 are sealed, adhered or secured to the front and rear walls 12, 14 of the package or bag 10 as described with respect to FIG. 5A. The first flange wall 42 includes a first interlocking profile 48 (illustrated as a male element with an arrowhead) on the interior wall thereof, which interlocks with a second interlocking profile 50 (illustrated as a female with arms to receive and releasably interlock with the arrowhead shape of the male element) on the interior of second flange wall 44. The first and second interlocking profiles 48, 50 comprise the interlocking zipper element 46. In a closed configuration of the reclosure, closure or zipper 40, the first and second interlocking profiles 48, 50 are releasably interlocked with each other. In an open configuration of the reclosure, closure or zipper 40, the first and second interlocking profiles 48, 50 are at least partially released from each other The present disclosure may be practiced with a wide variety of equivalent reclosures, closures or zippers, as would be recognized by one skilled in the art.

As shown in FIGS. 5A and 5C, the first ends 41 of first and second flange walls 42, 44 can be sealed together to form first reclosure seal 30 and the second ends 43 of first and second flange walls 42, 44 can be sealed together to form second reclosure seal 32. For structural clarity, both FIGS. 5C and 5D illustrate the first and second side gussets 16, 18 somewhat spread apart, but the actual product is typically flattens this area which is pinned, glued or sealed together (such, but not limited to, a hot melt adhesive or similar material).

Thus the several aforementioned objects and advantages are most effectively attained. Although preferred embodiments of the invention have been disclosed and described in detail herein, it should be understood that this invention is in no sense limited thereby.

What is claimed is:

1. A large-format package or bag, configured and arranged to hold at least fifteen pounds of content, comprising:

a first wall and a second wall;

a first gusset connecting first edges of the first wall and the second wall;

a second gusset connecting second side edges of the first wall and the second wall;

a first notch in the first gusset, including a portion of the first wall and the second wall;

a second notch in the second gusset, including a portion of the first wall and the second wall; and a reclosure, closure or zipper at least partially attached to an exterior of the first wall and second wall, covering the first notch and the second notch, extending over and across the upper edge of the first wall and the second wall, and wherein portions of the reclosure, closure or zipper are attached to each other through the first notch and the second notch.

2. The large-format package or bag of claim 1 wherein the first notch includes portions of the first edge of the first wall and the second wall and the second notch includes portions of the second edge of the first wall and the second wall.

3. The large-format package or bag of claim 2 wherein the first notch and the second notch are on opposed extremes of an upper edge of the first and second walls.

4. The large-format package or bag of claim 3 wherein portions of the first gusset, the first wall and the second wall are pinned, glued or sealed together proximate to the first notch.

5. The large-format package or bag of claim 4 wherein portions of the second gusset, the first wall and the second wall are pinned, glued or sealed together proximate to the second notch.

6. The large-format package or bag of claim 5 wherein ends of the reclosure, closure or zipper are flush with edges of the package or bag.

7. The large-format package or bag of claim 6 wherein the first wall, the second wall, the first gusset and the second gusset are formed from a tube of polymeric or polywoven material.

8. The large-format package or bag of claim 7 wherein the tube is formed from a single sheet of polymeric or polywoven material, wherein edges of the sheet are joined by a seal.

9. The large-format package or bag of claim 8 wherein the seal is a lap seal.

10. The large-format package or bag of claim 5 wherein the reclosure, closure or zipper includes a first flange wall with a first interlocking element and a second flange wall with a second interlocking element wherein, in a closed configuration, the first interlocking element is releasably interlocked with the second interlocking element.

11. The large-format package or bag of claim 10 wherein the first interlocking element is a male element and the second interlocking element is a complementary female element.

* * * * *